US008677875B2

(12) United States Patent
Hubert-Habart et al.

(10) Patent No.: US 8,677,875 B2
(45) Date of Patent: Mar. 25, 2014

(54) MOTOR-DRIVEN UNIT FOR CLEARING MINES FROM AND SECURING A HAZARDOUS ROUTE

(75) Inventors: Christophe Hubert-Habart, Meudon (FR); Dominique Hembise, Plaisir (FR)

(73) Assignee: MBDA France, Paris (FR)

( * ) Notice: Subject to any disclaimer, the term of this patent is extended or adjusted under 35 U.S.C. 154(b) by 225 days.

(21) Appl. No.: 13/255,434

(22) PCT Filed: Mar. 16, 2010

(86) PCT No.: PCT/FR2010/050463

§ 371 (c)(1),
(2), (4) Date: Sep. 8, 2011

(87) PCT Pub. No.: WO2010/106281

PCT Pub. Date: Sep. 23, 2010

(65) Prior Publication Data

US 2012/0000350 A1 Jan. 5, 2012

(30) Foreign Application Priority Data

Mar. 19, 2009 (FR) ..... 09 01275

(51) Int. Cl.
*F41H 11/12* (2011.01)

(52) U.S. Cl.
USPC ..... 89/1.13; 86/50; 102/402

(58) Field of Classification Search
USPC ..... 89/1.13; 86/50; 102/402; 404/93, 111, 404/94
See application file for complete search history.

(56) References Cited

U.S. PATENT DOCUMENTS

| | | | | |
|---|---|---|---|---|
| 3,771,413 | A * | 11/1973 | Sieg et al. | 89/1.13 |
| 5,203,923 | A * | 4/1993 | Hartman | 118/669 |
| 5,307,272 | A * | 4/1994 | Butler et al. | 700/90 |
| 5,313,868 | A * | 5/1994 | Wolf | 89/1.13 |
| 5,712,441 | A * | 1/1998 | Grunewald | 89/1.13 |
| 5,869,967 | A * | 2/1999 | Straus | 324/326 |
| 6,915,728 | B2 * | 7/2005 | Renwick et al. | 89/1.13 |
| 7,481,144 | B2 * | 1/2009 | Simula et al. | 89/1.13 |
| 7,685,917 | B2 * | 3/2010 | Reeves et al. | 89/1.13 |
| 8,240,239 | B1 * | 8/2012 | Diaz | 89/1.13 |
| 2004/0035285 | A1 * | 2/2004 | Renwick et al. | 89/1.13 |

(Continued)

FOREIGN PATENT DOCUMENTS

| | | |
|---|---|---|
| CA | 2 234 597 A1 | 10/1999 |
| EP | 1 388 724 A2 | 2/2004 |

(Continued)

OTHER PUBLICATIONS

International Search Report completed Jul. 14, 2010 and mailed Jul. 23, 2010 from corresponding International Application No. PCT/FR2010/050463 filed 16 Mar. 2010 (3 pages).

(Continued)

*Primary Examiner* — Jonathan C Weber
(74) *Attorney, Agent, or Firm* — Klein, O'Neill & Singh, LLP

(57) ABSTRACT

The present disclosure relates to a motor-driven unit for clearing mines from and securing a hazardous route. According to the present method, system and device, a marker apparatus for a secured route is a liquid material for marking on the ground, and comprising dispensing members for providing one axial marking and two side markings on either side of said axial marking, respectively, for said route.

20 Claims, 2 Drawing Sheets

(56) References Cited

U.S. PATENT DOCUMENTS

| | | | | |
|---|---|---|---|---|
| 2004/0037645 | A1 | 2/2004 | Harrison | |
| 2004/0149199 | A1 * | 8/2004 | Frank et al. | 116/100 |
| 2008/0092725 | A1 * | 4/2008 | Simula et al. | 89/1.13 |
| 2008/0236376 | A1 * | 10/2008 | Reeves et al. | 89/1.13 |
| 2012/0186421 | A1 * | 7/2012 | Firth | 89/1.13 |

FOREIGN PATENT DOCUMENTS

| | | | | |
|---|---|---|---|---|
| EP | 1 434 024 | A1 | 6/2004 | |
| FR | 1 592 195 | A | 5/1970 | |
| GB | 2 126 958 | A | 4/1984 | |
| GB | 2260153 | A * | 4/1993 | E01C 23/16 |

OTHER PUBLICATIONS

Written Opinion completed Jul. 14 2010 and mailed Jul. 23 2010 from corresponding International Application No. PCT/FR2010/050463 filed 16 Mar. 2010 (11 pages).

* cited by examiner

MOTOR-DRIVEN UNIT FOR CLEARING MINES FROM AND SECURING A HAZARDOUS ROUTE

CROSS-REFERENCE TO RELATED APPLICATIONS

This is a national phase application under 35 U.S.C. §371 of PCT Application No. PCT/FR2010/050463, filed Mar. 16, 2010, which claims the benefit of French application Ser. No. 09/01275 filed Mar. 19, 2009, the contents of which are expressly incorporated herein by reference.

FIELD OF ART

The present disclosure relates to a motor-driven unit for clearing mines from and securing a hazardous route, such as a track or a road of a conflict area, able to comprise mines or other explosive devices.

BACKGROUND

To this end, the motor-driven unit should not only carry out mine clearing from the relevant route through anti-mine means carried by said unit and allowing, upon their passage, for the detection and/or the activation of explosive loads of mines and other devices, but it should also provide securing the mine cleared track by means of an appropriate beaconing equipment so as to allow, after the unit has passed, the traffic of other vehicles or convoys in complete safety.

This is, for instance, the case of the motor-driven unit described in U.S. Pat. No. 4,747,515, comprising a vehicle such as a tank, at the front of which anti-mine means are arranged as a pressing roll activating the latter, and at the rear of which a beaconing equipment is mounted as individual marking blocks arranged evenly and automatically in the central longitudinal axis of the track being followed by the vehicle. Thus, the follower vehicles of such a leading vehicle guide their progress relying on the aligned central blocks.

However, such a beaconing equipment imposes a significant clutter, because of the high number of blocks to be stored for marking a track with beacons, and, consequently, a beaconing distance limited to a few kilometers. Moreover, guiding the follower vehicles using central spaced apart blocks does not occur in a stringent and accurate way, so that a follower vehicle could become more or less off-centered with respect to the alignment of the blocks and laterally deviate from the track, then driving on a mine.

Furthermore, if this type of marking block beaconing is well appropriate for beaconing a substantially flat route in a good condition, on the other hand, when the route is uneven and has bankings, reliefs or stony areas, the arranged blocks are able to fall, and to no longer correctly indicate the route to be followed. Furthermore, when the positioned beacon should be removed for any reason (end of a mission, etc.), the marking blocks should be recovered, requiring a logistics and an additional cost.

Moreover, from patent CA-2,234.597, a vehicle is known for detecting land mines comprising anti-mine means and a beaconing equipment for the secured route. The beaconing equipment comprises a marking product and two product dispensing members, respectively arranged on both sides of the central longitudinal axis of the vehicle so as to implement and leave on the ground two lateral markings, the spacing of which corresponds at least to the largest path axle of the vehicle.

Although it improves securing tracks, the guidance of vehicles that follow, between the lateral markings, is however unreliable because the marking vehicle is generally no longer visible and can no longer act as a reference point, and that the sight of the driver of the follower vehicle(s) could naturally focus on one of the two markings instead of staying between them. Thereby, the guidance of follower vehicles is inaccurate and is able to deviate from the secured path.

SUMMARY

The present method, system and device aim at overcoming such drawbacks and relates to a motor-driven unit for clearing mines intended for securing a hazardous route, the design of which allows, more specifically, for beaconing the track on a large distance, an optimum guidance of the follower vehicles and a reliable and secure marking of the route, whatever the track or the road being followed, without having to recover the beaconing equipment.

To this end, the motor-driven unit for mine clearing from and securing a hazardous route, of the type comprising anti-mine means and an equipment for beaconing the secured route comprising:

a tank containing a marking product;

members for dispensing said marking product, respectively arranged on both sides of the central longitudinal axis of said unit so as to implement lateral markings, the spacing of which corresponds at least to the largest path axle of the unit; and motive means for bringing the marking product from said tank to said dispensing members, is remarkable, according to the present method, system and device, in that, in addition to said lateral marking dispensing members, said beaconing equipment comprises a dispensing member arranged in the central longitudinal axis of said unit for implementing an axial marking of said route, and in that said marking product is liquid.

Thus, thanks to the present method, system and device, the beaconing equipment allows further materializing the actually secured area by means of three parallel traces, two lateral markings for materializing the mine cleared area and an axial marking for guiding follower vehicles, and this without making use of bulky difficult solutions and with a relative reliability.

For example, the unit could comprise:

a first leading vehicle which carries said beaconing equipment with lateral and axial markings and the wheels of at least one axle of which make up a part of a mass decoy equipment of said anti-mine means for securing longitudinal lanes of said track through said wheels passing therethrough; and at least one second follower vehicle being guided on said axial marking and following said longitudinal lanes being secured by said first vehicle, said second vehicle being further provided with several wheel axles making up the remainder of said mass decoy equipment and having different paths therebetween and with said mass decoy axle of the first vehicle, so as to totally secure the track width delimited by said lateral markings, through the juxtaposition of all said achieved longitudinal lanes.

Thus, the axial marking allows for the accurate alignment of the second follower vehicle on the first one, all the more as they are often remote from each other by about one hundred meters or more, thus optimizing the overlaps between the different juxtaposed longitudinal lanes being mine cleared by the action of the rolling members. And the lateral markings delimit the mine cleared area of the track for the following vehicles and convoys guided by the axial marking. Thereby, a convoy arriving after the unit has passed therethrough, knows the secured area to be followed staying between the two lateral markings.

In particular, said first vehicle comprises a trailer on which said beaconing equipment and said corresponding part of said mass decoy equipment are mounted, and said second vehicle also comprises a trailer on which the remainder of said mass decoy equipment is arranged.

Preferably, at least said dispensing members with lateral markings are transversally settable with respect to the longitudinal axis of said unit. Thus, the spacing between the lateral dispensing members could be adapted to the width or path of the largest axle in the presence of the unit.

In particular, said dispensing members are spraying guns.

In a preferred embodiment, the opening of said dispensing members is automatically controllable so as to be able to implement discontinuous markings on the ground and with determined lengths, being spaced apart from each other. Such an arrangement allows reducing the quantity of product to be used and to increase accordingly the length of the track able to be processed, without, nevertheless, be detrimental to the follow up of the markings by the drivers of follower vehicles or other convoys.

For instance, said lateral markings and said axial marking are identical and discontinuous.

In such a case, they could be offset therebetween according to a predetermined constant pitch.

Alternatively, said lateral markings are different from the axial marking.

Advantageously, said liquid marking product is a paint. Thus, with a simple tank of paint, a secured traffic lane can be delimited rapidly, efficiently and on a large distance, whatever the type of lanes being encountered (including, sandy, gravelly, lateritic, etc.).

In a preferred embodiment, said motive means are defined by a motive unit connected to a pump in communication with said tank of marking product and with said dispensing members.

BRIEF DESCRIPTION OF THE FIGURES

The figures of the appended drawing will better explain how the present method, system and device can be implemented. In these figures, like reference numerals relate to like components.

DETAILED DESCRIPTION

Figure 1:
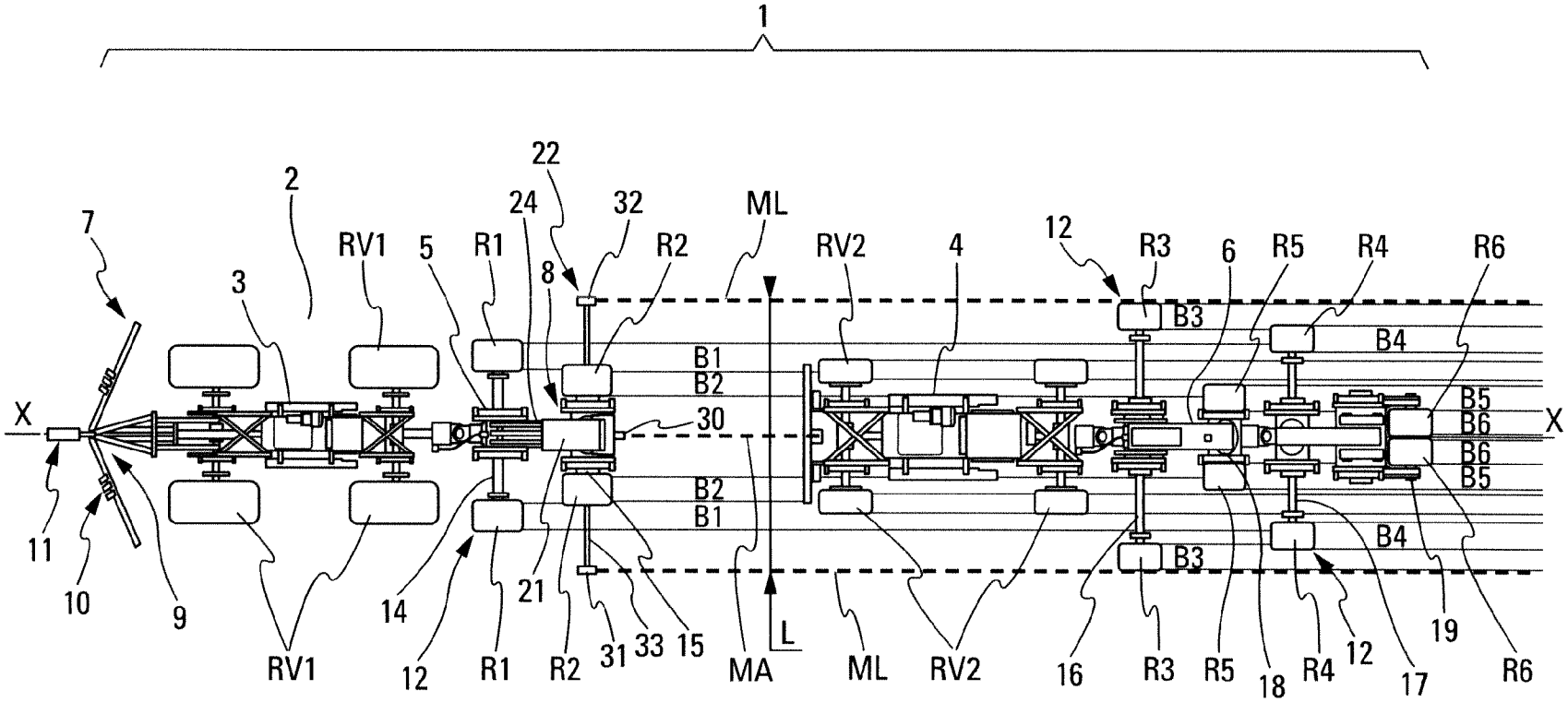
FIG. 1 schematically shows, in a bottom view, an embodiment of the motor-driven unit for mine clearing and securing a hazardous route according to the present method, system and device.

The aim of the motor-driven unit 1 shown on FIG. 1 is to provide mine clearing and securing a hazardous route, such as a track 2, wherein not shown mines or explosive devices are able to be totally or partially buried or concealed.

In the illustrated example, the motor-driven unit 1 comprises two vehicles 3, 4, to which respective trailers 5, 6 are coupled, i.e. a first leading vehicle 3 and its trailer 5 and one second follower motor-driven vehicle 4 and its trailer 6 actually comprising two sub-trailers coupled to each other. Both vehicles preferably drive as a convoy, the follower vehicle 4 being for instance remote by about one hundred meters from the leading vehicle 3. Naturally, a motor-driven unit could be contemplated with one single vehicle with one or more trailers or one jointed vehicle without or with a trailer, but with regard to the hostile areas or regions to be followed, it is appropriate to have a controllable unit with several replaceable sets or elements being able to rapidly and readily be operated, without disrupting for a long period of the time the progress of the unit.

For mine clearing and securing the track 2, the unit comprises means 7 for fighting against mines and explosive devices so as to detect and activate them, and a piece of equipment 8 for beaconing the then secured track after the passage of the unit, so as to allow other vehicles to follow it in all safety.

The anti-mine means 7 will not be described in full detail here but briefly, they comprise different equipment for coping with various threats.

Thus, at the front of the vehicle 3, on a structure with transversal arms 9, a mechanical decoy equipment 10 (claws, antennas, etc.) is arranged for activating the wire sensors and antennas of explosive devices, and a thermal decoy equipment 11 for activating the infrared sensors of devices. And for the mine pressure sensors, a mass decoy equipment 12 is provided and defined, in the present example, by the wheels of several specific axles, pressed on the ground via resilient means (not shown) for activating mines and thereby securing the track, with the other equipment.

Thus, for covering an appropriate track width L being at least as wide as the largest (transversal distance between the wheels of one single axle) of a vehicle able to follow it, several two wheel axles are provided, for instance two axles 14 and 15 on the trailer 5 of the first vehicle 3 and four axles 16, 17, 18 and 19 on the double trailer 6 of the second vehicle 4, so that the parallel longitudinal traces or lanes left behind by the tires are juxtaposed and cover the entirety of the desired width of the track 2, as shown on FIG. 1.

More particularly, the tires of the wheels R1 and R2 of the axles 14 and 15 of the trailer 5 leave median longitudinal traces or lanes B1 and B2 behind, being juxtaposed because the path of the axle 15 is lower than that of the axle 14, the lanes B1 and B2 left behind by the tires on the same side somewhat overlapping each other.

Advantageously, the longitudinal lanes B1, B2 left behind by the tires R1, R2 of the axles 14, 15 of the trailer of the vehicle 3 are thus followed by the motive wheels RV2 of the second follower vehicle 4, in all safety. It should be noticed, furthermore, that the motive wheels RV1 of the first leading vehicle 3 comprise "furtive" specific tires allowing to drive on the track without activating mines, so that axles with wheels pressed on the ground (such as the axles 14 and 15) are not necessary before the wheels RV1. Naturally, if the wheels of the vehicle 3 were provided with standard tires, mounting pressed wheels, for instance, on the transversal arms 9 of the equipment 10 would be contemplated, so that while the vehicle progresses, the motive wheels RV1 of the leading vehicle 3 drive on the longitudinal lanes left behind by the pressed wheels.

As far as other axles provided on the double trailer 6 of the follower vehicle, two axles 16 and 17 are external to the previous ones and have higher paths than that of the axle 14, so that their respective wheels R3 and R4 leave, on both sides of the track, external longitudinal traces or lanes B3 and B4 somewhat overlapping each other, the longitudinal lanes B4 of the axle 17 overlapping those B1 left behind by the trailer 5 of the leading vehicle 3. And two axles 18 and 19 are internal to the axle 15 and leave, via the respective wheels R5 and R6, internal longitudinal traces or lanes B5 and B6 overlapping each other. The set of longitudinal lanes B1 to B6 covering the entirety of the width L of the track 2.

Figure 2:
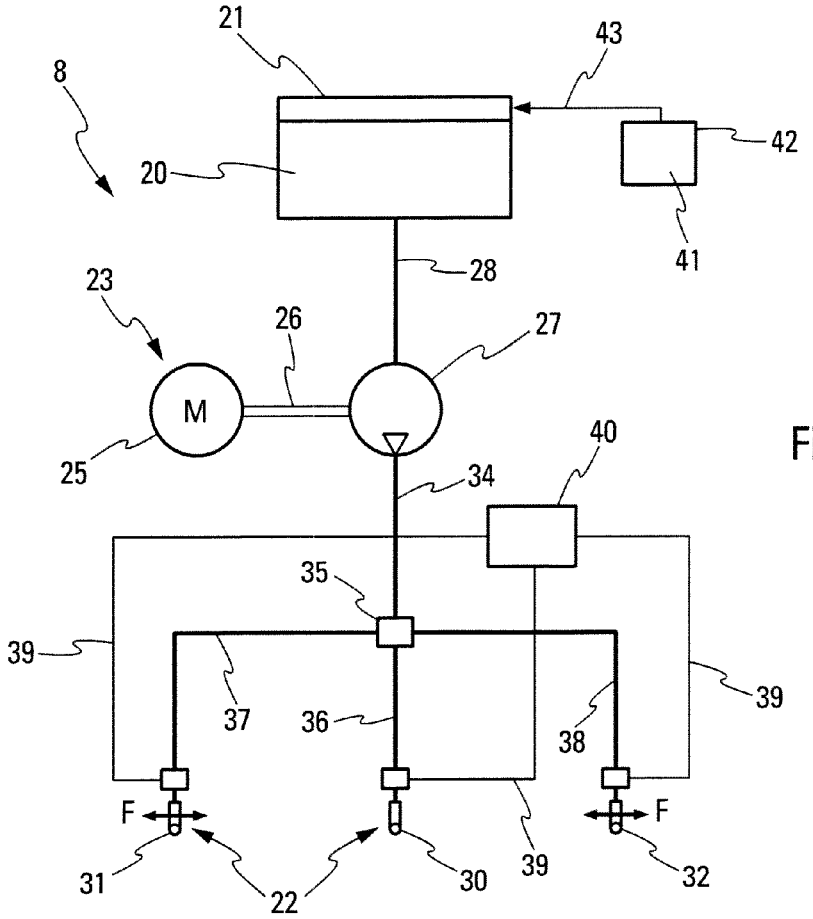
FIG. 2 schematically shows the equipment for beaconing the secured route, mounted on said motor-driven unit.

According to the present method, system and device, the equipment 8 for beaconing the secured route comprises a liquid marking product 20, such as a paint and, as schematically shown on FIG. 2, it comprises a tank 21 containing the paint 20, members 22 for dispensing the paint on the ground of the track 2 to be beaconed and motive means 23 for supplying the paint 20 from the tank 21 to the dispensing members 22.

FIG. 1 shows that the beaconing equipment 8 is provided on the trailer 5 of the leading vehicle 3, the tank thereof 21 mounted on the structure 24 thereof, similarly to the motive means 23 being defined, in the present example, by an electric motor-pump 25 connected via a coupling 26 to the paint pump 27 arranged at the outlet of the tank via a link 28, as shown on FIG. 2.

The dispensing members 22 are spraying guns being advantageously in the number of three arranged in parallel with each other. A first spraying gun 30, connected to the trailer 5, is arranged in the central longitudinal axis X of the unit 1, so as to leave behind on the ground an axial marking MA at the centre of the track 2 as a result of the paint 20 being sprayed.

Such an axial marking MA allows the driver of the second follower vehicle 4 of the unit 1 to align at the best to the first leading vehicle 3 (which vehicle could be located at more than one hundred meters ahead), so as to remain between the two lateral markings and to optimize the overlaps between the different longitudinal traces or lanes B1 to B6 being cleared of mines, so as not to have not processed space therebetween.

The second and third spraying guns 31 and 32 are, as far as they are concerned, arranged respectively on both sides of the first gun 30 while being carried by transversal arms 33 being integral with the trailer 5, so as to leave behind on the ground, as a result of the paint 20 being sprayed, lateral markings ML being located at least on the longitudinal lanes B3 generated by the wheels R3 of the largest path axle, in the present case, the axle 16. FIG. 1 shows that the side marks ML illustrated as a broken line thus surround the external edges of the tires of the wheels R3 of the axle 16, i.e. the longitudinal lanes B3.

These lateral markings ML allow delimiting the secured area of the track 2 for the following vehicles and convoys, the latter having to remain in the mine cleared traffic lane, beaconed by the lateral markings ML. It should be noticed that the tires of the wheels R6 could somewhat delete the axial marking MA, but this is irrelevant because its first function involves guiding the second vehicle 4 so that the lanes B1 to B6 are juxtaposed B6, and then the other vehicles.

Functionally, a link 34 connects the outlet of the pump 27 to a by-pass fluidic member 35 to which guns 30, 31, 32 are connected via respective links 36, 37 and 38.

Advantageously, the side spraying guns 31 and 32 are transversally settable in position, either in a manual or motorized way, and this is shown on FIG. 2 with a double arrow F associated with each side gun. Transversally setting the side beaconing allows to position the side guns according to the different desired mine clearing widths and configurations of the mine clearing trailers to be used.

Furthermore, the spraying guns 30, 31 and 32 have a controllable opening automatically managed by a calculator 40 of the leading vehicle 3 they are connected to via links 39, so as to achieve discontinuous markings MA and ML on the ground, with a constant length and with intervals being constant as well, and this, whatever the motion speed of the leading vehicle. Naturally, a paint saving is thereby achieved.

Figure 3:
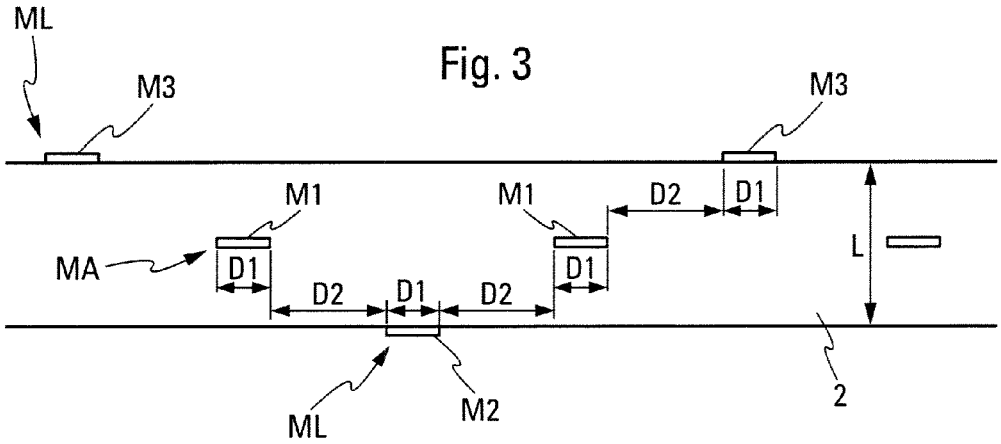
FIG. 3 is an embodiment of axial and lateral markings being left behind by the motor-driven unit on the track.

Thus, for further optimizing the paint saving, an alternate beaconing could be provided, such as that shown on FIG. 3, allowing to successively apply, according to the following cycle, a mark M1 with a length D1 by the first central gun 30, then after a distance D2, a mark M2 with a length D1 by the second side gun 31, then again, after a distance D2, a mark M1 by the first central gun 30 and afterwards, after a distance D2, a mark M3 with a length D1 by the third side gun 32, and so on, separating the successive marks by an appropriate distance (D2 in this example) so as not to impair the follow up of the secured area.

In order to improve the accuracy of the follow up of the mine clearing vehicles, the central beaconing is continuous in a bend. Detecting the bend is then achieved by the calculator of the leading vehicle by means of lock sensors positioned on its actuating wheels.

Regarding the paint to be used, this could be a water paint, more particularly of a white color, to which a coloring agent 41 can be added such as that contained in an appended tank 42 being able to be put in communication with the tank 21 via a link 43.

Adding a coloring agent to the paint allows, while replacing the coloring agent upon each passage with time, for instance every day or less frequently, to distinguish the marks from one passage to the other, even if the motor-driven unit follows the same route on several consecutive days.

Moreover, the paint should be able to provide a marking on different types of ground such as bitumen, a compacted sandy track, a gravelly or stony track, a compacted stony track, a compacted lateritic track, etc. And its application to the ground should allow to see it up to a few hours.

Thus, by cold weather, preferably the paint is mixed with an anti-frost agent of the ethylene-glycol type, the dosage of which depends on the temperature being encountered, and allowing to provide a good viscosity of the paint.

Furthermore, several settings of the paint parameters (flow rate, etc.) are preferably available so as to allow to consider the variation of the viscosity of the paint with the room temperature.

Alternatively, the paint guns could be provided with a not shown system for unblocking the nozzles. Unblocking each nozzle is controlled by the calculator of the motor-driven vehicle and could be activated after some time, a distance being followed or when the flow rate of the paint measured at the level of the pump is lower than a specified value.

By way of information, the paint pump is set so that the amount of paint applied upon the opening of the guns is lower than 100 g/m$^2$. Thus, with a 300 liter tank and with the ratios between the different above mentioned lengths of marking D1 and D2 of approximately 1 to 10, a route could be beaconed, in the order of 150 kilometers.

The invention claimed is:

1. A motor-driven unit for clearing land mines along a hazardous route, said motor-driven unit comprising:

at least one of a mechanical decoy equipment, a thermal decoy equipment, and a mass decoy equipment for detecting, activating, or both detecting and activating land mines;

a framed structure comprising an axle having two wheels and defining a central longitudinal axis having a first side and a second side straddling the axis;

a tank containing a marking product mounted on the framed structure;

a beaconing equipment for providing markers, said beaconing equipment comprising end dispensing members for dispensing the marking product downwardly to the ground arranged on the first side and the second side of the central longitudinal axis to dispense laterally spaced markings; said laterally spaced markings defining a spacing therebetween corresponding to a width the two wheels on the axle of the framed structure will travel on or inside thereof;

a motive device for moving the marking product from the tank to the end dispensing members; and wherein said beaconing equipment further comprises an intermediate dispensing member arranged and fixed between the end dispensing members to produce an intermediate marking between the two laterally spaced markings.

2. The unit according to claim 1, wherein said end dispensing members are transversally adjustable with respect to the central longitudinal axis.

3. The unit according to claim 1, wherein said end dispensing members are spray guns.

4. The unit according to claim 1, wherein said end dispensing members are controllable to produce discontinuous markings on the ground.

5. The unit according to claim 1, wherein said laterally spaced markings and said intermediate marking are identical and discontinuous.

6. The unit according to claim 5, wherein said laterally spaced markings and said intermediate marking are offset and have a constant predetermined pitch.

7. The unit according to claim 1, wherein said laterally spaced markings are different from said intermediate marking.

8. The unit according to claim 1, wherein said marking product is a paint.

9. The unit according to claim 1, wherein said motive device comprises a pump in communication with said marking product inside said tank.

10. The unit according to claim 1:

wherein the framed structure is a first leading vehicle carrying said beaconing equipment; and at least one second follower vehicle being guided on said intermediate marking and following said first vehicle, said second vehicle comprising several axles with wheels forming a mass decoy equipment.

11. The unit according to claim 10, wherein said first vehicle comprises a trailer on which said beaconing equipment is mounted and said second vehicle further comprises a trailer comprising at least one axle comprising two wheels.

12. The unit according to claim 1, further comprising a second follower vehicle spaced from the framed structure, said second follower vehicle comprising at least two axles each with at least two wheels having different total widths than the axle with two wheels on the framed structure; and wherein the wheels on the framed structure and the wheels on the second follower define at least three different lanes.

13. The unit according to claim 1, wherein the intermediate marking is located approximately halfway between the two laterally spaced markings.

14. A motor-driven unit for clearing land mines along a hazardous route, said motor-driven unit comprising:

at least one of a mechanical decoy equipment, a thermal decoy equipment, and a mass decoy equipment for detecting, activating, or both detecting and activating land mines mounted directly or indirectly to a lead vehicle, said lead vehicle comprising a framed structure comprising a first axle comprising two wheels and a second axle comprising two wheels; said lead vehicle comprising a central longitudinal axis having a first side and a second side straddling the axis;

a tank containing a marking product mounted on the framed structure of the lead vehicle;

a beaconing equipment for providing markers, said beaconing equipment comprising end dispensing members for dispensing the marking product downwardly to the ground arranged on the first side and the second side of the central longitudinal axis to dispense laterally spaced markings; said laterally spaced markings defining a spacing therebetween corresponding to a width that is the same as or larger than any two wheels on an axle of a second vehicle will travel;

a motive device for moving the marking product from the tank to the end dispensing members; and wherein said beaconing equipment further comprises an intermediate dispensing member arranged between the end dispensing members to produce an intermediate marking between the two laterally spaced markings and generally along the central longitudinal axis of the first vehicle.

15. The unit according to claim 14, wherein said end dispensing members are transversally adjustable with respect to the central longitudinal axis.

16. The unit according to claim 14, wherein said end dispensing members are spray guns.

17. The unit according to claim 14, wherein said end dispensing members are controllable to produce discontinuous markings on the ground.

18. The unit according to claim 14, wherein said laterally spaced markings and said intermediate marking are identical and discontinuous.

19. The unit according to claim 18, wherein said laterally spaced markings and said intermediate marking are offset and have a constant predetermined pitch.

20. The unit according to claim 14, wherein said laterally spaced markings are different from said intermediate marking.

* * * * *